US005566947A

United States Patent [19]

Tucker et al.

[11] Patent Number: 5,566,947

[45] Date of Patent: Oct. 22, 1996

[54] LACROSSE STICK HAVING OPEN SIDEWALL STRUCTURE

[75] Inventors: Richard B. C. Tucker, Baltimore; Fielding H. Lewis, Jr., Queenstown; Jackie L. Davis, Aberdeen, all of Md.

[73] Assignee: STX Inc., Baltimore, Md.

[21] Appl. No.: 392,688

[22] Filed: Feb. 23, 1995

Related U.S. Application Data

[63] Continuation of Ser. No. 193,640, Feb. 7, 1994, abandoned, which is a continuation of Ser. No. 49,654, Apr. 21, 1993, abandoned, which is a continuation of Ser. No. 918,789, Jul. 27, 1992, abandoned, which is a continuation of Ser. No. 770,726, Oct. 4, 1991, abandoned, which is a continuation of Ser. No. 647,697, Jan. 29, 1991, abandoned, which is a continuation of Ser. No. 778,067, Sep. 20, 1985, abandoned.

[51] Int. Cl.[6] ..... A63B 59/02

[52] U.S. Cl. ..... 273/326; 273/73 R

[58] Field of Search ..... 273/326, 73 C, 273/73 G, 83, 26 B, 167 E, 167 D, 167 F, 73 R

[56] References Cited

U.S. PATENT DOCUMENTS

| | | | |
|---|---|---|---|
| Re. 31,419 | 10/1983 | Frolow | 273/73 C |
| 346,751 | 8/1886 | Hillman | 273/73 D |
| 1,877,820 | 9/1932 | Costello | 273/26 B |
| 3,910,578 | 10/1975 | Brine | 273/326 |
| 3,934,876 | 1/1976 | Haddad | 273/73 C |
| 4,358,117 | 11/1982 | Deutsch | 273/326 C |

*Primary Examiner*—Gary Jackson

*Attorney, Agent, or Firm*—Connolly & Hutz

[57] ABSTRACT

A double-wall, synthetic head for a lacrosse stick having a substantial area of the sidewalls with openings is described. The lacrosse stick head enables optimum speed and handling by a player while retaining the required strength and durability of the lacrosse stick head.

9 Claims, 2 Drawing Sheets

LACROSSE STICK HAVING OPEN SIDEWALL STRUCTURE

This is a continuation of application Ser. No. 08/193,640 filed Feb. 7, 1994, now abandoned which, in turn, is a continuation of Ser. No. 08/049,654 filed Apr. 21, 1993, now abandoned; which, in turn, is a continuation of Ser. No. 07/918,789 filed Jul. 27, 1992, now abandoned; a continuation of Ser. No. 09/770,726 filed Oct. 4, 1991, now abandoned; a continuation of application Ser. No. 07/647,697 filed Jan. 29, 1991, now abandoned; and application Ser. No. 06/778,067 filed Sep. 20, 1985, now abandoned.

FIELD OF INVENTION

This invention relates in general to new and useful improvements in lacrosse sticks. More particularly, it relates to the construction of a new lightweight lacrosse stick comprising a double-wall, synthetic plastic head having an opening or openings in the sidewalls thereof.

BACKGROUND OF INVENTION

Double-wall, synthetic heads for lacrosse sticks, referred to at times as double-wall, synthetic lacrosse sticks, are described in Tucker et al, U.S. Pat. No. 3,507,495. The lacrosse stick defined in the Tucker et al patent has improved feel, balance, and durability as well as uniformity and economy of manufacture in comparison to the single-wall, wooden, and handmade lacrosse sticks used since ancient times. As a result, the popularity of the game of lacrosse has increased greatly, thereby increasing the level of competition and skill among lacrosse players.

Although the above-noted double-wall construction of lacrosse sticks is highly satisfactory as determined by the substantially universal acceptance of these sticks, it has now been determined, due to the degree of competition and the superior skill among present day lacrosse players, that a lighter weight, easier handling lacrosse stick would be useful to the lacrosse player. A lightweight lacrosse stick will provide the lacrosse player with a lacrosse stick enabling optimum speed and handling during the lacrosse match. The stick must, however, at the same time, retain the required strength and durability.

PRIMARY OBJECTS AND GENERAL DESCRIPTION OF THE INVENTION

Accordingly, this invention provides a new lightweight lacrosse stick having a double-wall, synthetic head having an opening or openings in the sidewalls to provide lightness and easy handling while retaining the strength and durability of the prior art lacrosse sticks having closed, or substantially closed, or solid sidewalls.

Another object of this invention is to provide a new lightweight lacrosse stick having a double-wall, synthetic head having an opening in the sidewalls in a trestle-like configuration.

Another object of this invention is to provide a new lightweight lacrosse stick having sidewalls wherein from approximately 7.0% to 65% of each sidewall surface is open, preferably in the range of from about 25% to 35%.

Still another object of this invention is to provide a new lightweight lacrosse stick having a double-wall, synthetic head having an opening or openings in the sidewalls which provides improved handling and playing characteristics.

Other objects and advantages of the present invention will become apparent from the following general and detailed description taken in conjunction with the appended drawing.

Brief, the objects and advantages of the present invention are obtained by providing a lacrosse stick having a head with a generally V-shaped frame adapted to receive a web. The frame is defined by two sidewalls joined at a juncture and diverging therefrom. A transverse wall joins the ends of the sidewalls opposite of the juncture. The area of the transverse wall is at times referred to as the scoop end of the head. This is as shown in the aforesaid Tucker et al patent. According to the present invention the sidewalls of the head are made or constructed having one or more openings therein. The opening or openings in the sidewalls, while providing unique advantages in the handling of the lacrosse stick, do not in any way detract from the playability characteristics of the lacrosse stick. The lacrosse sticks of this invention have the strength and durability found in the prior art lacrosse sticks such as in the aforesaid Tucker et al patent.

DRAWING AND DETAILED DESCRIPTION

Figure 1:
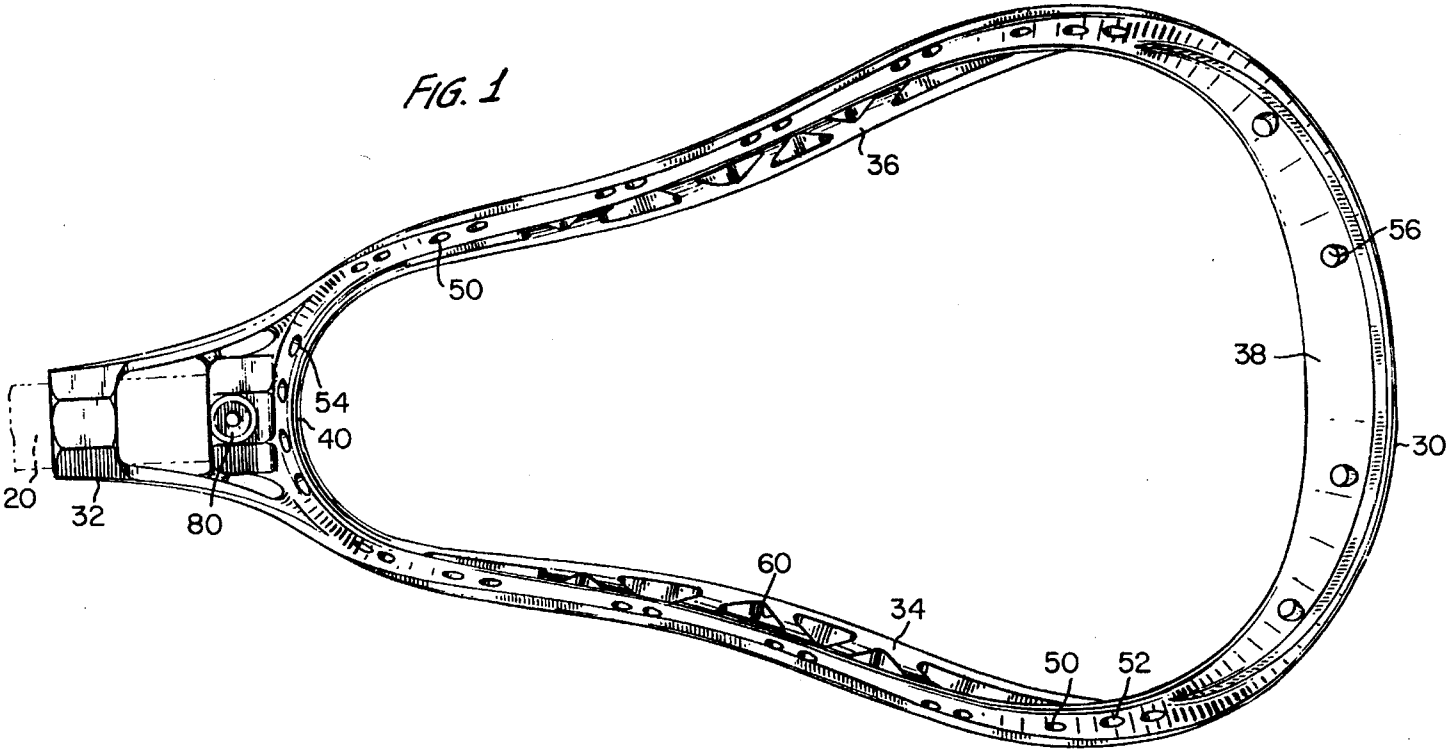
FIG. 1 is a rear elevational view of the lacrosse stick embodying the invention.

Referring to the drawing, lacrosse stick 10 comprises a handle 20 shown in phantom lines and broken away, and a double-wall, synthetic head 30. The head 30 comprises a generally V-shaped frame having a juncture 32, sidewalls 34 and 36, a transverse wall 38 joining the sidewalls at the end opposed to juncture 32, and a stop member 40 formed in the embodiment of FIG. 1 integral with the sidewalls. As shown, handle 20 fits into and through juncture 32 and abuts stop member 40. A web (not shown) is attached to the rear portion of the head through string holes 50 and 52 in the sidewalls, 54 in the stop member, and 56 in the transverse wall. The aforementioned features of the lacrosse sticks are all shown generally in Tucker et al, U.S. Pat. No. 3,507,495. In accordance with the present invention, however, the sidewalls 34 and 36 of head 30 have one or more openings generally designated by the numeral 60 to provide for a lighter weight superior handling lacrosse stick.

Figure 2:
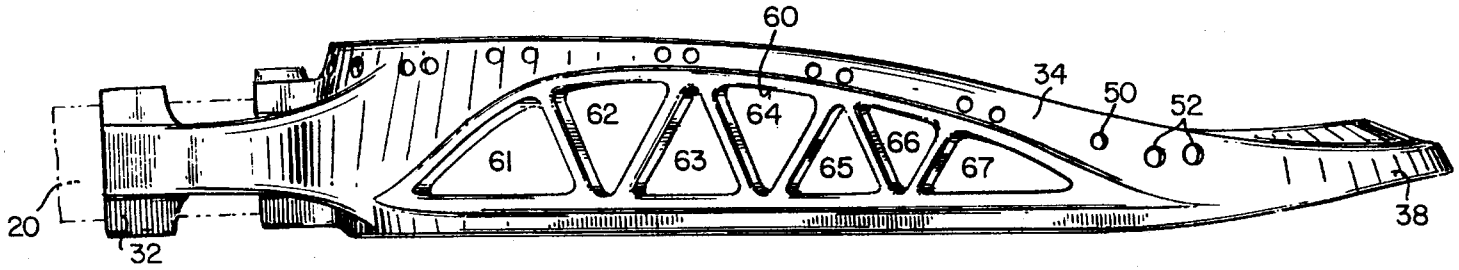
FIG. 2 is a side elevational view showing the stick when looking from the right of FIG. 1.

Specifically, FIGS. 1–5 show the sidewalls 34 and 36 having an opening, generally designated by numeral 60, in each sidewall having a trestle-like structure, as best shown in FIG. 2. The trestle-like structure is a preferred embodiment of the invention as it is one means of providing an opening in the sidewalls for a lighter stick while concurrently providing the required support, strength, and durability in the lacrosse stick.

While a preferred embodiment of the invention utilizes an opening 60 in each sidewall in a trestle-like structure, the invention includes an opening in each sidewall in any shape, including as an oval or a rectangle. Further, the invention may be comprised of one or more openings in the sidewalls in any of numerous shapes such as ovals, circles, squares, triangles, rectangles, or other polygonal structures. The only limiting factor in the number, size, or shape of the openings is in providing a lacrosse stick with the required strength and durability, which will vary depending on the nature of the game and player, e.g., men's, women's, or children's lacrosse.

Referring again to the sidewalls 34 and 36, and specifically to sidewall 34 as shown in FIG. 2, the sidewall contains an opening 60 in a trestle-like configuration with specific openings 61, 62, 63, 64, 65, 66, and 67 each in a triangular shape. In the embodiment shown, the area of each of the sidewalls 34 and 36 is 12.99 square inches. The trestle-like configuration has an open area of 3.88 square inches. Specifically, the height, base, and area of triangles 61–67 are as follows:

| Opening | Base | Height | Area |
|---|---|---|---|
| 61 | 1.750 | .970 | .8488 |
| 62 | .915 | 1.140 | .5216 |
| 63 | .960 | 1.100 | .5280 |
| 64 | .880 | 1.050 | .4620 |
| 65 | .965 | 1.125 | .5428 |
| 66 | .760 | .900 | .3420 |
| 67 | 1.600 | .800 | .6400 |

for a total area of 3.8852. The open area is, therefore, 9.91% of the total area of the sidewall.

The sidewall 36 also contains a plurality of openings 50 and 52 required for stringing the webbing material as is conventional. The preferred embodiment shown in the drawing includes eleven 5/32 inch diameter stringing holes 50 and two 7/32 inch diameter stringing holes 52. The minimum number of stringing holes in the sidewall for a useful lacrosse stick are six 5/32 inch diameter holes and one 7/32 inch diameter hole. The area of each of string holes 50 is 00.0192 square inches and string holes 52 is 00.0377 square inches, or a total area of 00.2866 square inches. Accordingly, the total area of openings in each sidewall 34 and 36, including string holes and trestle-like openings, is 4.1718 square inches or 32.12% of the entire sidewall.

While the preferred embodiment as set forth above provides for a 32.12% opening in each sidewall 34 and 36, the percentage opening may vary dependant on the specific characteristics desired for the lacrosse stick. Specifically, it has been found that the percentage amount of opening can be in the range of about 7% to 65% while providing the benefits of the invention. It has been found that an opening in excess of about 7% of the sidewall will provide a lighter weight, easier handling lacrosse stick. Further, by controlling the opening, it has been found that total openings of up to about 65% may be utilized while still retaining the strength and durability required for a lacrosse stick.

Figure 3:
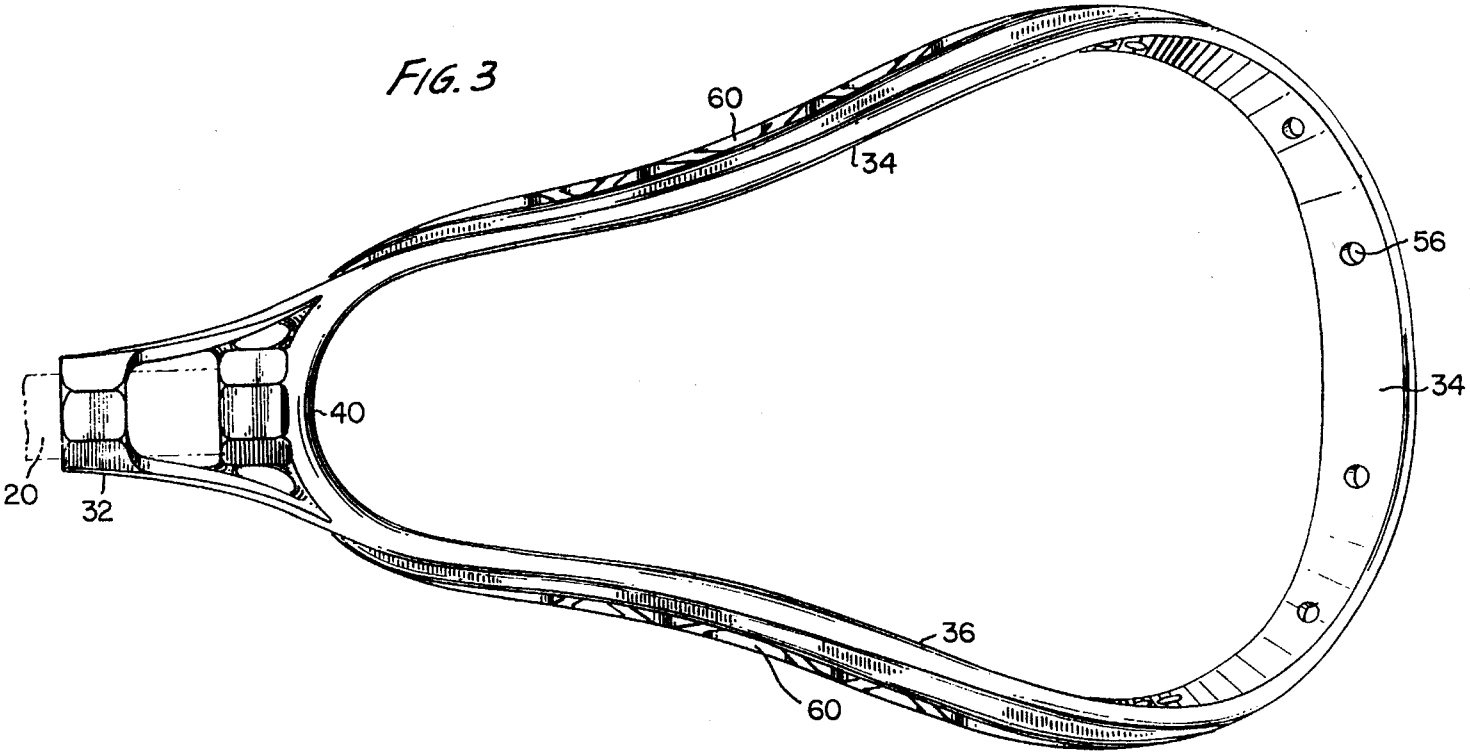
FIG. 3 is a front elevational view of the stick shown in FIGS. 1 and 2.

FIG. 3 more specifically illustrates the preferred shade and configuration of the invention as shown in FIG. 1, but as seen from a front elevational view.

Figure 4:
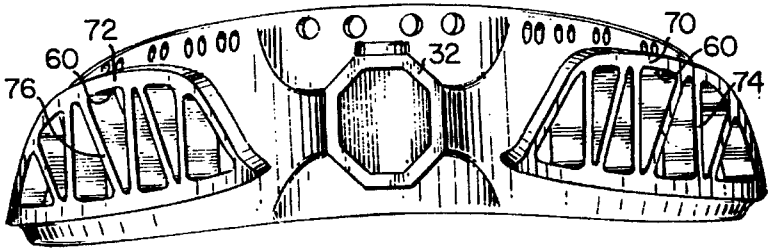
FIG. 4 is a section view of FIG. 1 showing the lacrosse stick head of the invention in bottom plan.

FIG. 4 more specifically illustrates the preferred shape and configuration of the invention as seen in bottom plan. Specifically, it is noted that in making or constructing the preferred embodiment of the invention, the trestle-like openings 60 have ridges 70 and 72 outwardly extending from the sidewalls 34 and 36 surrounding the opening as well as outwardly extending ridges 74 and 76 forming the trestle-like supports. The outwardly extending ridges 70, 72, 74, and 76 increase the thickness of the sidewalls and provide additional strength and support to the lacrosse stick head.

Figure 5:
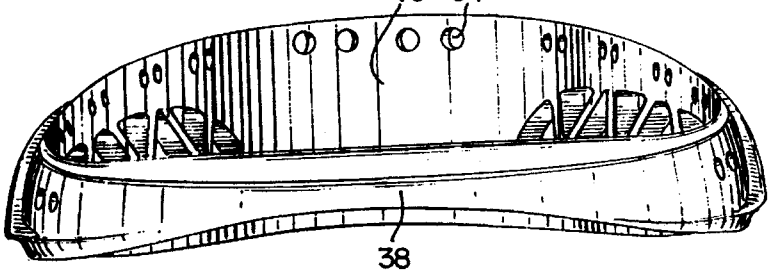
FIG. 5 is a section view of FIG. 1 showing the lacrosse stick head of the invention in top plan.

As best seen in FIGS. 1 and 5, the inside portion of sidewalls 34 and 36 are smooth without any ridges in order to facilitate throwing and catching of the lacrosse ball.

As seen in FIGS. 1 and 4, the handle 20 is inserted through throat 32 into stop 40. The handle 20 in the preferred embodiment is octagonal, although other shaped handles may be used. The handle can be held in place by a screw or other means inserted through hole 80 as shown in FIG. 1 if desired.

The material forming the lacrosse stick head of the invention must have physical properties providing, inter alia, toughness, impact resistance, and limited flexibility as well as shatterproof qualities. The preferred material is a moldable thermoplastic or thermosetting elastomer such as nylon or the urethanes which are well known in the art, and are made from reactants which are normally blended in the liquid state and cast into suitable molds where they are heated to produce the cured and shaded lacrosse stick heads. For example, the lacrosse stick head may be formed by injection molding of one or more synthetic polymeric materials.

The complete process of forming the lacrosse stick head of the invention involves several operations which are performed in sequence and in combination to produce the finished product of this invention, such operations being defined in Tucker et al, U.S. Pat. No. 3,507,495, the disclosure thereof being incorporated herein by reference.

Various modifications will be recognized by one skilled in the art based on the present teaching. For example, to make the stick even lighter, it can be desirable to include open areas in the scoop or transverse wall of the head. Thus, although only a select preferred embodiment has been specifically illustrated and described herein, it is to be understood that various modifications and embodiments can be utilized to provide the lightweight lacrosse stick of the present invention without departing from the spirit of the invention and scope of the appended claims.

It is claimed:

1. A head for a lacrosse stick which provides improved handling and playing characteristics comprising a generally V-shaped frame constructed of a synthetic polymeric material defined by two sidewalls joined at a juncture and diverging therefrom, a transverse wall joining tile ends of said sidewalls opposite of said juncture, said frame being adapted to receive a web, and said sidewalls having openings therein, the area of said openings including string holes comprising in the range of from about 7% to 65% of the entire area of said sidewalls.

2. The head for a lacrosse stick of claim 1 wherein the area of said openings is in the range of 25% to 35% of the entire area of said sidewalls.

3. The head for a lacrosse stick of claim 1 wherein the area of said openings is in the range of 30% to 33% of the entire area of said sidewalls.

4. The head for a lacrosse stick of claim 3 wherein said openings are in a trestle-like configuration comprised of three to seven triangular openings.

5. The head of a lacrosse stick of claim 4 wherein said trestle-like configuration is comprised of seven triangular openings.

6. The head of a lacrosse stick of claim 5 wherein said trestle-like configuration extends outwardly from said sidewalls.

7. The head for a lacrosse stick of claim 1 wherein said openings are in a polygonal shape.

8. The head for a lacrosse stick of claim 7 wherein said polygonal shaped openings are triangular.

9. The head for a lacrosse stick of claim 8 wherein said head is formed by injection molding of a synthetic polymeric material.

* * * * *

UNITED STATES PATENT AND TRADEMARK OFFICE

CERTIFICATE OF CORRECTION

PATENT NO. : 5,566,947

DATED : October 22, 1996

INVENTOR(S) : Richard B.C. Tucker, ET AL

It is certified that error appears in the above-indentified patent and that said Letters Patent is hereby corrected as shown below:

Column 3, line 24, 9.91% should read 29.91%

Column 4, line 38, "tile" should read "the"

Signed and Sealed this

Twenty-eighth Day of January, 1997

*Attest:*

Bruce Lehman

BRUCE LEHMAN

*Attesting Officer*

*Commissioner of Patents and Trademarks*

US005566947B1

REEXAMINATION CERTIFICATE (3663rd)

United States Patent [19] [11] B1 5,566,947

Tucker et al. [45] Certificate Issued Nov. 3, 1998

[54] SIDEWALL STRUCTURE

[75] Inventors: Richard B. C. Tucker, Baltimore; Fielding H. Lewis, Jr., Queenstown; Jackie L. Davis, Aberdeen, all of Md.

[73] Assignee: STX Inc., Baltimore, Md.

Reexamination Request:
No. 90/004,704, Jun. 30, 1997

Reexamination Certificate for:

| | |
|---|---|
| Patent No.: | **5,566,947** |
| Issued: | **Oct. 22, 1996** |
| Appl. No.: | **392,688** |
| Filed: | **Feb. 23, 1995** |

Related U.S. Application Data

[63] Continuation of Ser. No. 193,640, Feb. 7, 1994, abandoned, which is a continuation of Ser. No. 49,654, Apr. 21, 1993, abandoned, which is a continuation of Ser. No. 918,789, Jul. 27, 1992, abandoned, which is a continuation of Ser. No. 770,726, Oct. 4, 1991, abandoned, which is a continuation of Ser. No. 647,697, Jan. 29, 1991, abandoned, which is a continuation of Ser. No. 778,067, Sep. 20, 1985, abandoned.

[51] Int. Cl.[6] ..... A63B 59/02

[52] U.S. Cl. ..... 473/513

[58] Field of Search ..... 473/510, 512, 473/513

[56] References Cited

U.S. PATENT DOCUMENTS

| | | |
|---|---|---|
| D. 263,248 | 3/1982 | Brine, Jr. . |
| D. 286,666 | 11/1986 | Brine, Jr. . |
| D. 286,803 | 11/1986 | Brine, Jr. . |
| 891,813 | 6/1908 | Ceel . |
| 2,039,138 | 4/1936 | Auer . |
| 2,508,519 | 5/1950 | Jay . |
| 3,473,806 | 10/1969 | Patterson . |
| 3,591,178 | 7/1971 | Milligan et al. . |
| 3,702,702 | 11/1972 | Hoult . |
| 4,387,898 | 6/1983 | Mangum . |
| 4,405,026 | 9/1983 | Gillespie . |
| 4,657,260 | 4/1987 | Brine, Jr. . |

OTHER PUBLICATIONS

Brine, Inc., "Coaches/Instructors Guide to 'McWhipit'" (1980).

*Primary Examiner*—Gary Jackson

[57] ABSTRACT

A double-wall, synthetic head for a lacrosse stick having a substantial area of the sidewalls with openings is described. The lacrosse stick head enables optimum speed and handling by a player while retaining the required strength and durability of the lacrosse stick head.

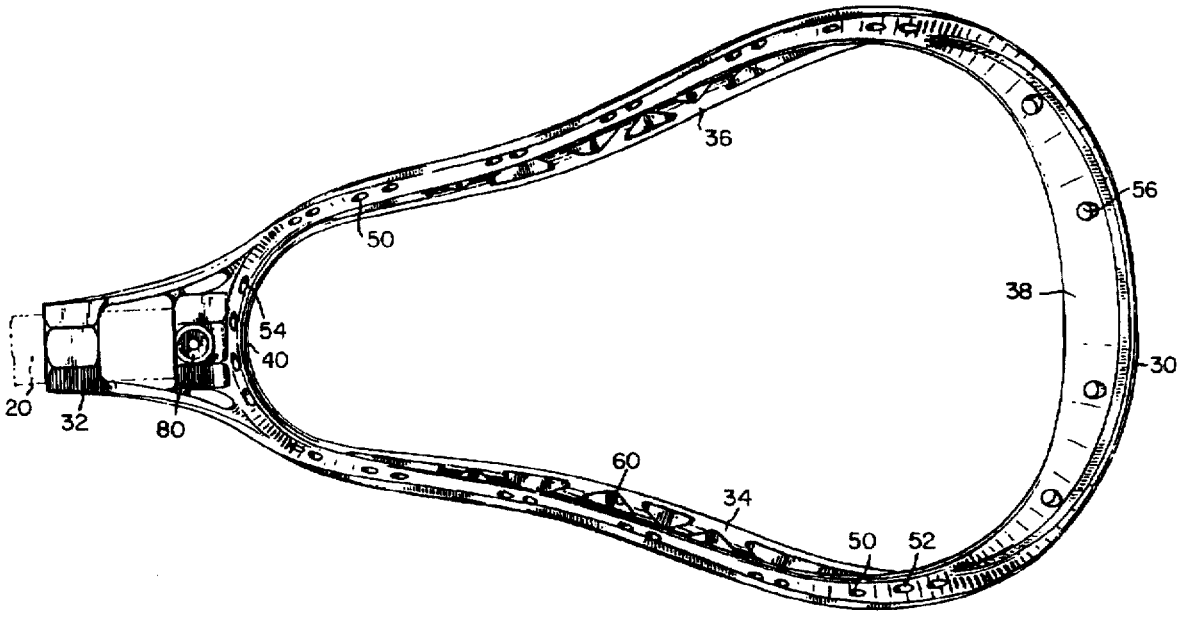

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-9 are confirmed.

* * * * *